US005452668A

United States Patent [19]

Hergeth et al.

[11] Patent Number: 5,452,668

[45] Date of Patent: Sep. 26, 1995

[54] DEVICE FOR SECURING LOADED GOODS

[75] Inventors: Willi Hergeth, Schlierseestr. 18, D-8201 Lauterbach; Franz Frei, Karlskron, both of Germany

[73] Assignee: Hergeth; Willi, Germany

[21] Appl. No.: 108,614

[22] PCT Filed: Oct. 22, 1992

[86] PCT No.: PCT/EP92/02437

§ 371 Date: Aug. 27, 1993

§ 102(e) Date: Aug. 27, 1993

[87] PCT Pub. No.: WO93/08089

PCT Pub. Date: Apr. 29, 1993

[30] Foreign Application Priority Data

Oct. 25, 1991 [DE] Germany ..... 41 35 228.9

[51] Int. Cl.[6] ..... B65D 19/44

[52] U.S. Cl. ..... 108/55.3; 108/54.1

[58] Field of Search ..... 108/51.1, 55.1, 108/55.3, 55.6, 56.1, 56.3, 54.1

[56] References Cited

U.S. PATENT DOCUMENTS

| | | | |
|---|---|---|---|
| 3,168,060 | 2/1965 | Farley . | |
| 4,015,710 | 4/1977 | Biggs | 108/55.5 X |
| 4,580,680 | 4/1986 | Wind | 108/55.3 X |
| 4,693,370 | 9/1987 | Aceti | 108/55.1 X |
| 4,735,310 | 4/1994 | Lemery et al. . | |
| 4,784,194 | 11/1988 | Danner | 108/55.3 X |
| 4,850,099 | 7/1989 | Scollard . | |
| 4,915,033 | 4/1990 | Bond | 108/55.1 |
| 4,993,548 | 2/1991 | Peterson . | |
| 5,092,252 | 3/1992 | Gillhart | 108/55.3 X |
| 5,097,951 | 3/1992 | Pigott et al. | 108/55.3 X |
| 5,329,862 | 7/1994 | Breezer et al. | 108/55.5 |

FOREIGN PATENT DOCUMENTS

| | | | |
|---|---|---|---|
| 2502439 | 7/1976 | Germany | 108/55.3 |
| 7732143 | 3/1978 | Germany . | |
| 8233404U1 | 4/1983 | Germany . | |
| 0113299A1 | 7/1984 | Germany . | |
| 33167743A1 | 11/1984 | Germany . | |
| 226531A1 | 8/1985 | Germany . | |
| 229370A1 | 11/1985 | Germany . | |
| 229369A1 | 11/1985 | Germany . | |
| 0207479A2 | 1/1987 | Germany . | |
| 3618996A1 | 12/1987 | Germany . | |
| 3630061A1 | 3/1988 | Germany . | |
| 8715915.5 | 3/1988 | Germany . | |
| 3728033A1 | 3/1989 | Germany . | |
| 1588647A1 | 8/1990 | U.S.S.R. . | |

*Primary Examiner*—Jose V. Chen

*Attorney, Agent, or Firm*—Evenson, McKeown, Edwards & Lenahan

[57] ABSTRACT

A device for variably securing loaded goods, preferably machine parts, on the bottom of stiff containers, in particular pallets, has a bottom plate provided with uniformly spaced apart receiving devices into which securing stays may be inserted in order to secure the parts. The securing stay is formed by a plurality of different bodies. An eccentric plug connection between the bodies allows the contour design of the securing stay to be widely varied in order to ensure optimum securing of the machine pans.

41 Claims, 5 Drawing Sheets

DEVICE FOR SECURING LOADED GOODS

BACKGROUND AND SUMMARY OF THE INVENTION

The invention relates to a device for variably securing loaded goods on the bottom area of stiff containers, the bottom area being provided with uniformly spaced receiving devices into which one securing stay respectively can be inserted while standing on the bottom area. This type of a device is known from German Patent Document DE 37 28 033 A1.

During the transport and storage of machine parts and other solid goods in containers, as, for example, on pallets, it is frequently necessary to secure these parts on the bottom of the containers in order to protect the valuable goods to be transported from damage.

For this reason, containers which comprise defined fixing devices for securing purposes and which are tailored specifically to the individual part, are frequently manufactured for sensitive and high-quality machine parts. These are usually expensive wood constructions with metal fittings. Even small changes in the dimensions of the machine part require a new construction of the container or a high-expenditure rebuilding of the securing fittings, as indicated with respect to the transport container with variable fittings known from U.S. Pat. No. 4,735,310.

For the flexible adaptation to different dimensions of loaded goods, a plurality of fittings are known. In the German Patent Document DE 37 28 033 A1, which forms the above-mentioned type, a device for the securing of loaded goods is disclosed whose bottom plate has uniformly spaced pinholes for receiving plug-in type holding elements. However, an exact enclosure of loaded goods by means of the holding elements is possible only when the pinholes are spaced very narrowly which will then reduce the stability of the bottom plate.

The same problems apply to the pallets with the plug-in-type securing elements suggested in German Patent Documents DD 229 370 A1 and DD 229 369 A1.

For receiving loaded goods in a manner that corresponds precisely to the contours, it is suggested in European Patent Document 207 479 A2 to adapt the head of the retention elements which can be plugged into a grid to the contour of the loaded goods. In this case, it is a disadvantage that a plurality of different retention elements are required in order to be able to also receive varying loaded goods.

On this basis, it is an object of the invention to provide a device according to the above-mentioned type which protects loaded goods from shifting and falling out and thus from being damaged. It must be possible to adapt the device in a simple and rapid manner to different dimensions of loaded goods. With a view to loaded goods which are sensitive to shocks, a securing of the loaded goods must be ensured that is largely free of play.

According to the invention, this object is achieved in that the securing stay comprises a first body which can be secured with the bottom surface and of at least a second body, with these bodies being connected by a pin plug-in connection eccentrically with respect to the longitudinal axis of the first body and the second body. The first body can be a bottom body and the second body an expansion body.

The essential advantages of the invention are that loaded goods and particularly machine pans of different dimensions can be secured in a flexible manner on bottom surfaces. The required securing may take place by a few, generally three securing stays, in which case the securing takes place by a simple resting of the loaded goods against or on the securing stays. Additional clamping devices, such as screwed or clamped connections, are not required in this case. The positioning of the securing stay with respect to the contact point of the loaded goods takes place by a rough or precise positioning of the securing stay and, as a result, is particularly time-saving and precise. The rough positioning of the securing stay takes place by inserting the securing stay in a receiving device which is close to the contact point. A securing of the loaded goods which is independent of the distant spacing of the receiving devices takes place by the precise positioning by via an eccentrically offset fitting-on of the expansion bodies of the securing stay. With respect to the operation, it was found to be particularly advantageous that the bodies of the securing stay can be mounted manually by a simple plugging without any additional devices. This permits a fast change-over of the securing stays for the adaptation to loaded goods of different dimensions.

In a preferred embodiment, the bodies of the stay are connected with one another in a frictionally engaged manner. This results in the required easy mounting, in which case it is nevertheless ensured that unstressed securing stays do not unintentionally fall apart in the case of an unfavorable position.

Another advantageous development of the invention provides a pin plug-in connection which can be operated easily and without errors by the mutual plugging-in of pin stubs formed on the bodies and recesses, which connection can also be produced at low cost.

Another advantageous further development of the invention offsets the longitudinal axis of the pin stub and of the recess by the distance "a" in parallel to the longitudinal axis of the respective body. The offset arrangement of the pin stubs and the recesses permits a larger offsetting area for the precise positioning than would be possible in the case of the offset arrangement of only the pin stub or the recess. As a result, the maximally usable offset amounts to twice the distance "a". Preferably, the pin stub is constructed as a regular prism, and the recess has a prismatic interior cross-section which corresponds to the pin stub, whereby in the fitted-together condition, an unintentional rotating of the bodies with respect to one another can be avoided. In this case, it is advantageous for the reliable securing of the loaded goods that the securing stay can be stressed with respect to torsion to a limited degree. In addition, as a function of the number of sides of the prism and corresponding to the interior cross-section, defined plug-in positions of the bodies with respect to one another can be determined. By marking of the bodies corresponding to the number of sides, selected plug-in positions can be described and can rapidly be found again.

In an advantageous further development of the invention, the securing stay can comprise a plurality of different expansion bodies, whereby the variety of applications is increased. For this purpose, the expansion body may be constructed as an elastic bearing body which has a cone point and a recess or the pin stub on its base area facing away from the cone point. As a result, also loaded goods with a complex contour can be held by the securing stays with a secure fit. The elastic design of the bearing body permits a careful fixing of loaded goods which are sensitive to shocks. In this case, it is particularly advantageous to use an elastomer as the material for the bearing body, which not only dampens shocks but also protects the bearing surface of the loaded goods from scratches and similar surface damage.

In a further additional development, according to which the expansion body is an intermediate body which has a central body bounded by two mutually parallel end faces, onto which central body, on the one side, the pin stub is molded on the end face side and the recess is molded on the other side, the securing stay may be constructed at almost any height and at almost any required offset. The flexibility of the design of the securing stay permits the adaptation also to complexly shaped loaded goods with low mounting expenditures.

An opposite offsetting of the pin stub and the recess permits a maximal eccentricity of the course of the securing stay for the optimal adaptation to the contour of the loaded goods without the requirement of changing the plug-in position of the securing stay on the bottom surface in an undesirable manner.

In a preferred embodiment, bodies rest flush against one another on their end faces in the fitted-together condition, whereby a large-surface load transfer is possible into the bottom surface or into the container in a material-protecting manner.

Additional advantageous embodiments of the invention ensure a secure and stable fit of the securing stay in the bottom surface so that also high loads of the transported goods occurring during the transport can be transferred.

A securing of the securing stay on the bottom plate against an unintentional detachment which operates in a simple manner and can be established at low expenditures, is obtained by a development of the invention according to which the bottom plate has, on its underside facing away from the securing stay, at least one pair of molded-on noses which project toward the opening, in which case one projection of the bottom body respectively can snap into the gap formed between the noses of a pair by the rotation of the bottom body.

Another advantageous development of the invention is formed by the regular arrangement of the openings on the bottom plate that permits not only a flexible rough positioning of the securing stays but, in the case of known dimensions of the loaded goods, such as the diameter of a pivoted part, a mathematical determination of optimal plug-in positions of the securing stays without any time-consuming iterative and manual determination of the plug-in positions. In addition, by counting or marking, frequently recurring plug-in positions may be found in a rapid and time-saving manner.

An expanded spectrum of positioning possibilities is the result of the embodiment of the invention according to which the crossing points of the plug-in grooves form receiving devices into which bottom bodies can be plugged without the requirement to change the grid distance. In particular, in conjunction with the embodiment of the invention according to which the base part of the bottom body can be inserted into the opening and into the intersecting point, the application possibilities of the invention are expanded.

A construction which expands the usage possibilities of the invention considerably is the result of the fact that conventional plug-in connections, such as those known from the German Patent Application P 40 14 734, can be inserted into the plug-in grooves.

An alternative embodiment provides that the securing stay consists of an individual body comprising the bottom body and the expansion body or bodies. While a releasable connection between the bottom body and the expansion body is eliminated, the use of an integral securing stay is possible while the mounting expenditures are reduced.

In the case of particularly high securing stays or heavy loaded goods, there is the danger that, in the case of hard impacts, the securing stays may be bent or damaged. In order to avoid this danger, the securing stays can be mutually supported in that, in a further development of the invention, the securing stays can be connected with one another by cross-linking devices, in which case the cross-linking devices have several receiving points which are spaced away from one another in the longitudinal direction of the cross-linking device, for the connection of one securing stay respectively with the cross-linking device, and the distance between the receiving points corresponds to the spacing of the receiving devices in the bottom surface. Furthermore, additional securing stays may be built upon the cross-linking devices so that the device is rendered more flexible. For this purpose, the receiving points are preferably formed by adjacent bores whose diameter is coordinated with the outside diameter of the securing stay, whereby cross-linking devices can simply be pushed on securing stays.

As an alternative to the construction of the receiving points as a bore, in a manner that is compatible with the pin plug-in connection, these are constructed as a recess for receiving a pin stub.

For connecting securing stays of one column or one row or of one diagonal on the grid-type bottom plate, the distance between the receiving points corresponds to the horizontal or diagonal spacing of the receiving devices in the bottom surface.

In the case of loaded goods with a bore, it is frequently advantageous to place these by way of the bore. Such loaded goods may also be secured by means of securing stays in that, for the adaptation of the securing stay to the, as a rule, larger bore diameter, a circular-ring body is pushed onto the securing stay. Preferably, this circular-ring body is formed by two concentric circular rings which are connected with one another by webs. This construction is stable and can be carried out in a simple manner.

Other objects, advantages and novel features of the present invention will become apparent from the following detailed description of the invention when considered in conjunction with the accompanying drawings.

DETAILED DESCRIPTION OF THE DRAWINGS

Figure 1:
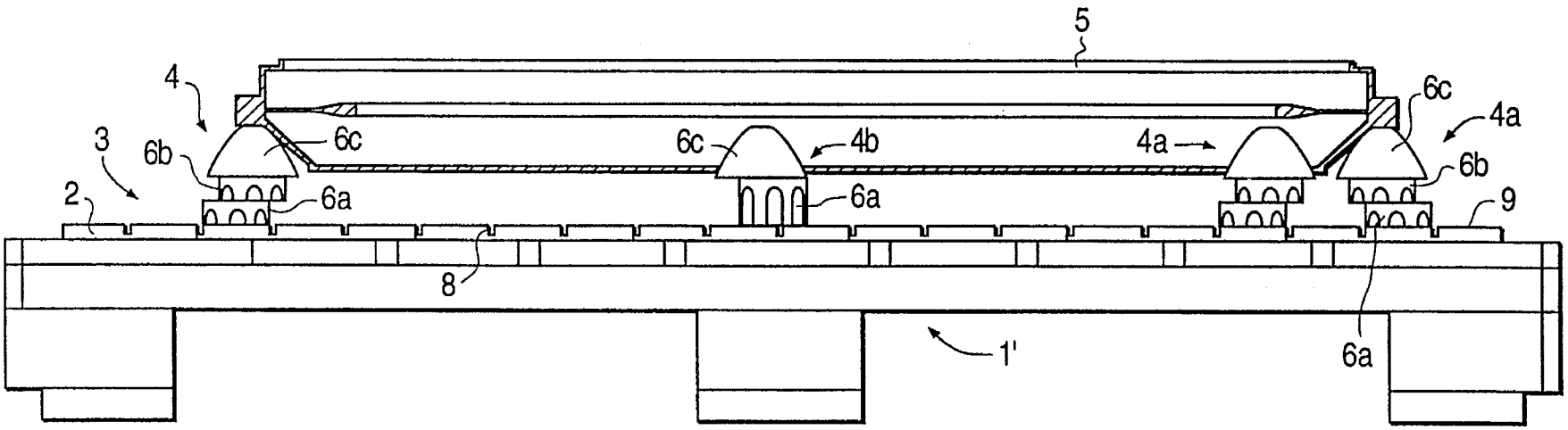
FIG. 1 is a view of a pallet constructed in accordance with an embodiment of the present invention with receiving devices and securing stays as well as a sectionally illustrated rotationally symmetrical machine part as the loaded merchandise.

FIG. 1 illustrates a pallet 1' with a bottom plate 3 which is screwed onto the surface and is composed of square partial plates 2. Furthermore, securing stays 4*a, b,* and *c* are fastened on the bottom plate 3, which fixing stays support and horizontally secure a machine part 5. The securing stays 4*a* and 4*c* are each composed of a bottom body 6*a,* an intermediate body 6*b* and an elastic bearing body 6*c,* in which case the intermediate body 6*b* is connected on its end faces with the adjacent bodies 6*a* and 6*c* by way of a pin plug-in connection. The intermediate body 6*b* and the elastic bearing body 6*c* can be considered to be expansion bodies. In the fitted-together condition, however, this connection is not visible. By an intermediate piece 6*b* fitted on in a rotated manner with respect to the bottom body 6*a,* and by providing an eccentrically molded pin plug-in connection molded eccentrically to the bodies 6*a*–6*c,* an offsetting is obtained between the bottom body 6*a* and the intermediate body 6*b*. This offsetting may be varied by a rotated fitting-on. In the connection between the bearing body 6*c* and the intermediate body 6*b* of the securing stays 4*a,* the mutual twisting angle is selected such that no offsetting is obtained between the two bodies 6*b* and 6*c*. In contrast to securing stays 4*a* and 4*c,* securing stay 4*b* comprises a lengthened bottom body 6*a* with bearing bodies 6*c* that are fitted on in an offset manner. The bearing bodies 6*c* comprise an elastomer that serves as a bearing point for the machine part 5. For a better adaptation to the contour of the machine part 5, these have a conical shape, in which case these supporting bodies 6*c* can be produced according to a desired contour with the correspondingly shaped body geometries. The bottom bodies 6*a* represent the link of the securing stays 4 with respect to the bottom plate 3 which are releasably connected with it by means of receiving devices 7 of the bottom plate 3.

Figure 2:
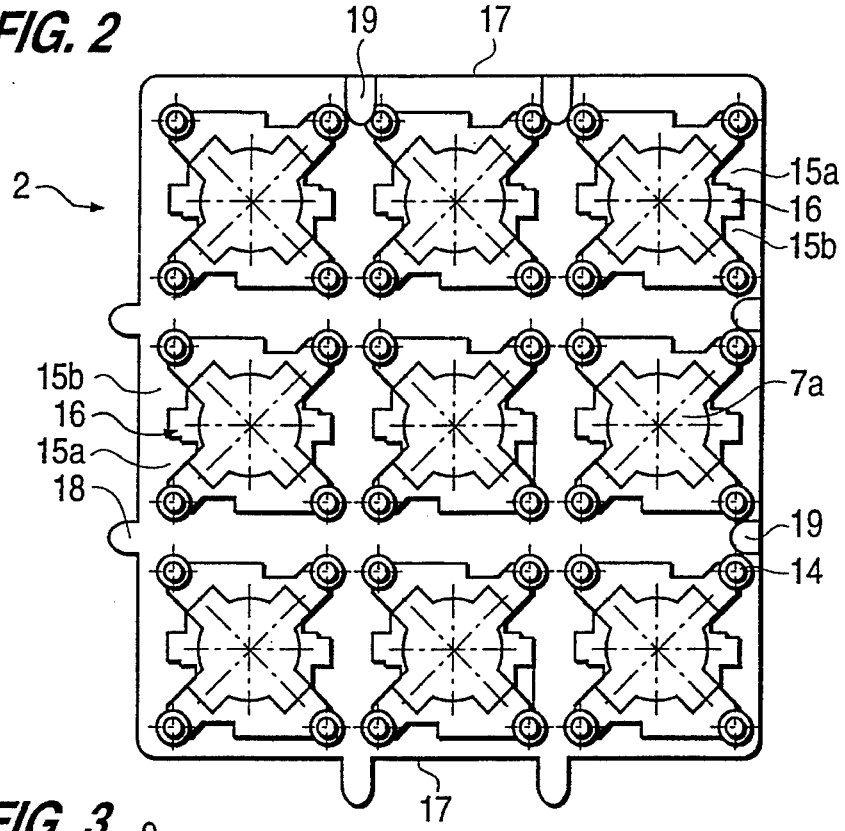
FIG. 2 is a view of the underside of a partial plate.
Figure 3:
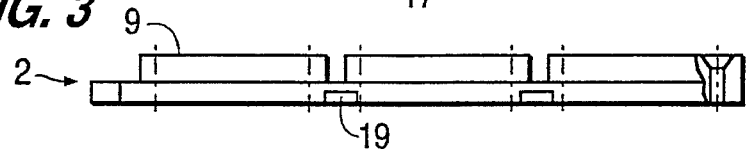
FIG. 3 is a lateral view of the partial plate.
Figure 4:
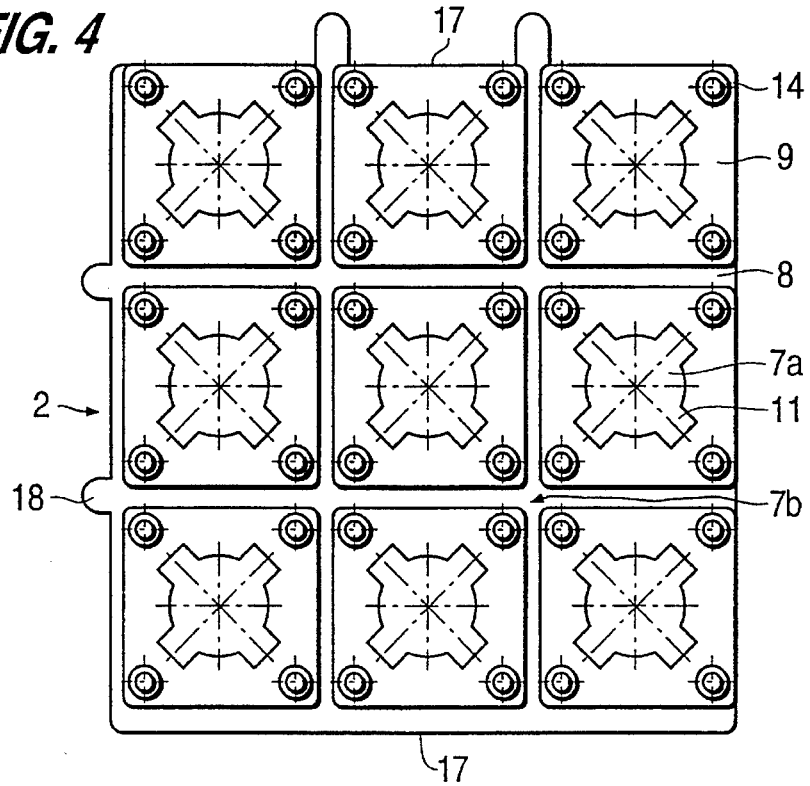
FIG. 4 is a top view of the partial plate.

FIGS. 2, 3 and 4 are views of a square partial plate 2. In the top view according to FIG. 4, the surface of the partial plate 2 can easily be recognized and is subdivided, in the manner of a chessboard, by means of plug-in grooves 8 which extend on the surface in a grid shape. The chessboard-type subdivision results in nine square individual areas 9 per partial plate 2, in whose centers one receiving device 7 respectively is provided which is constructed as an opening 7*a*. One base part 10 (see FIG. 5) respectively of a bottom body 6*a* can in each case be inserted in the openings 7*a* and can be connected with the opening 7*a* in the manner of a bayonet catch, in which case the bottom body 6*a* is disposed on the surface of the partial plate 2. For connecting the bottom body 6*a* with the partial plate 2, the circular openings 7*a* each have four slots 11 offset at a right angle with respect to one another which extend radially toward the outside on the edge of the opening 7*a*. Through these four slots 11, projections 12 can be fitted (see FIGS. 5 and 6) in a corresponding cross-shaped manner and are molded to the base parts 10 of the bottom bodies 6*a,* and by means of the rotation of the bottom body 6*a* about its longitudinal axis 13*a* can be connected with respect to the partial plate 2 in a bayonet-catch-type manner with the partial plate 2.

For the direct introduction of loads into the pallet 1', the individual areas 9 are provided with bores 14 and can be connected with the pallet 1' by screwed connections (see FIGS. 2 to 4). On the underside of the partial plates 2, two pairs of noses 15*a, b* are molded for each opening. These noses 15*a, b* project into the respective opening 7*a* between the slots 11 and are in each case diametrically opposite with respect to the opening 7*a*. In this case, the distance to the respective opening 7*a* or to the pertaining slots 11 is coordinated such that a projection 12 of the base part 10 can be snapped into the bayonet gap 16 constructed between the noses 15*a, b* of a pair by means of the rotation of the bottom body which is part of the base part 10 (see FIG. 2).

For the connection of the adjoining partial plates 2 with one another, these are provided with lugs 18 on their edges and with correspondingly shaped pockets 19, which can be form-fittingly inserted into one another.

Figure 5:
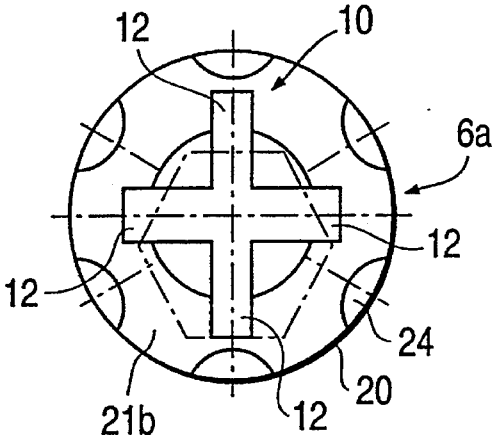
FIG. 5 is a view of the base of a bottom body.
Figure 6:
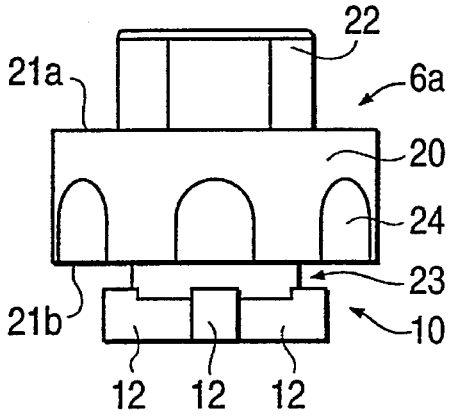
FIG. 6 is a lateral view of the bottom body.
Figure 7:
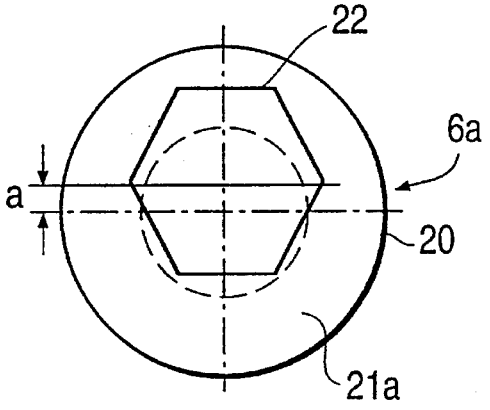
FIG. 7 is a top view of the bottom body.

FIGS. 5 to 7 are views of a bottom body 6*a*. This bottom body 6*a* comprises a cylindrical central body 20 and a base part 10 mounted on an end face 21*b* of the central body 20, and a pin stub 22 molded to the second end face 21*a*. The pin stub 22 is formed of a six-sided regular prism whose longitudinal axis is offset in parallel to the longitudinal axis of the central body 20 by a distance "a". In contrast, the cross-shaped base part 10, which is situated opposite the pin stub 22, is arranged concentrically to the central body 20. The four projections 12 of the base part 10 which are arranged offset with respect to one another at a right angle, form a gap 23 with respect to the end face 21*a,* which gap 23 corresponds to the bottom thickness in the edge area of the opening 7*a* of the partial plate 2.

For a better handling, the central body 20 is provided with recessed grips 24 on its circumference. According to the requirements, the dimensions of the central bodies 20 may be constructed in graduated sizes.

Figure 8:
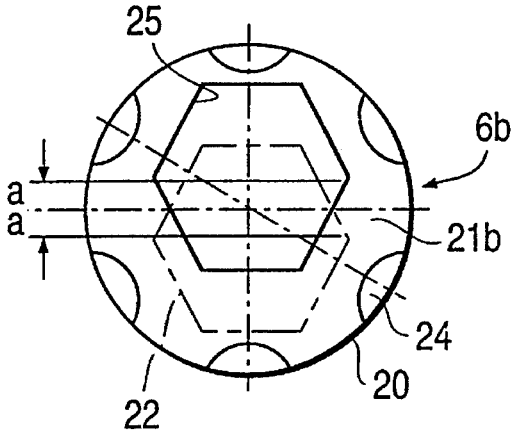
FIG. 8 is a view of the underside of an intermediate body.
Figure 9:
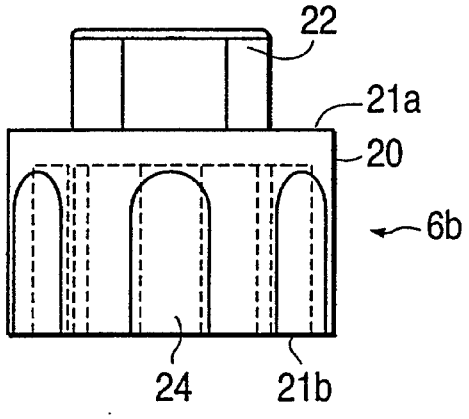
FIG. 9 is a lateral view of the intermediate body.
Figure 10:
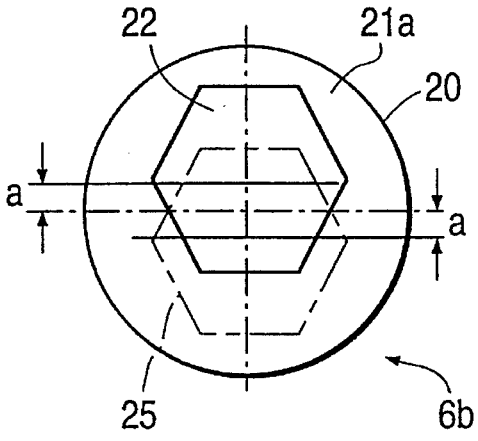
FIG. 10 is a top view of the intermediate body.

FIGS. 8 to 10 are views of the intermediate body 6*b* which is identical to the bottom body 6*a* with respect to the central body 20 and the pin stub 22. On its side of the central body 20 which faces away from the pin stub 22, however, a recess 25 is molded in which has a prismatic interior cross-section which corresponds to the pin stub 22. The longitudinal axis of the pin stub 22 and of the recess 25 are each offset with respect to one another at the distance a from the longitudinal axis of the central body 20, in which case the longitudinal axes are situated in a plane.

Figure 11:
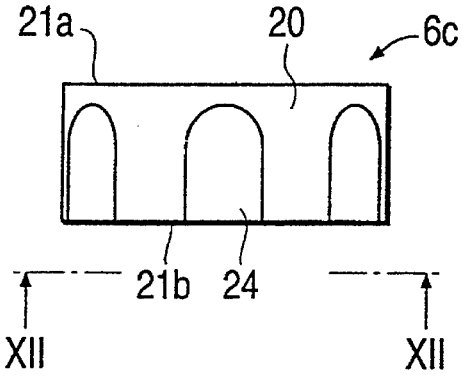
FIG. 11 is a lateral view of a bearing body with a flat bearing surface.
Figure 12:
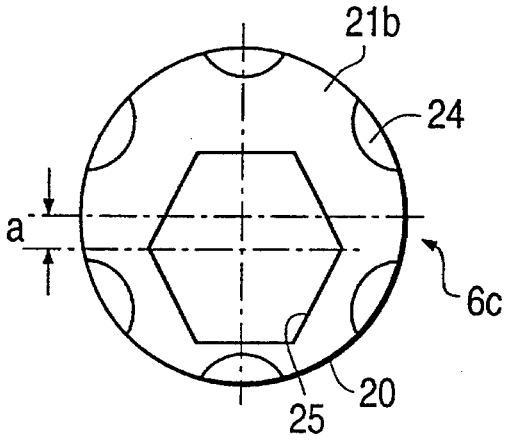
FIG. 12 is a view of the bearing body with a flat bearing surface according to FIG. 11.

FIGS. 11 and 12 illustrate views of a bearing body 6*c*. This bearing body 6*c* corresponds to the intermediate body 6*b* without any pin stub 22.

Figure 13:
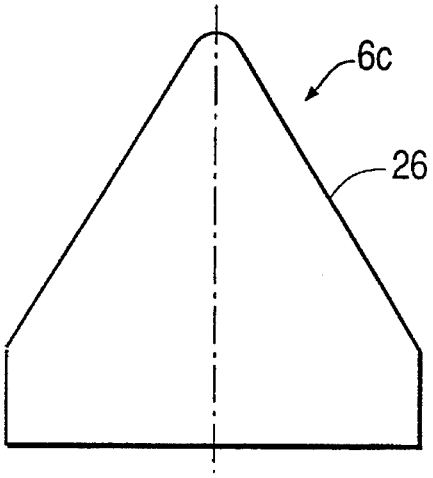
FIG. 13 is a lateral view of a bearing body with a conical bearing surface.
Figure 14:
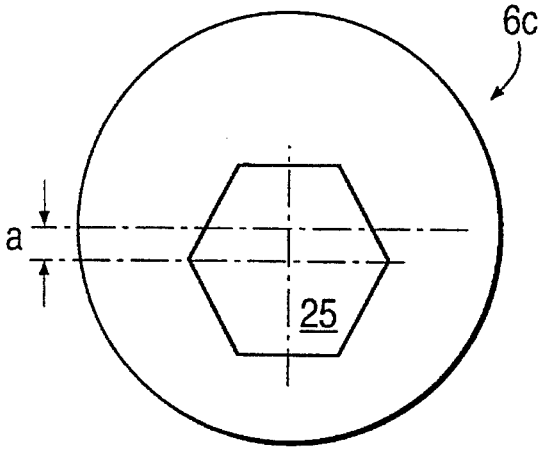
FIG. 14 is a view of the underside of the bearing body with a conical bearing surface.

FIGS. 13 and 14 reflect views of the elastic bearing body 6*c* in a conical shape. It has a cone point 26 and has, on the base surface facing away from the cone point 26, an above-described eccentrically arranged recess 25. The material of this elastic bearing body 6*c* is an elastomer, for example. The remaining bodies 6 and partial plates 2 are made of a recyclable plastic material, for example.

Figure 15:
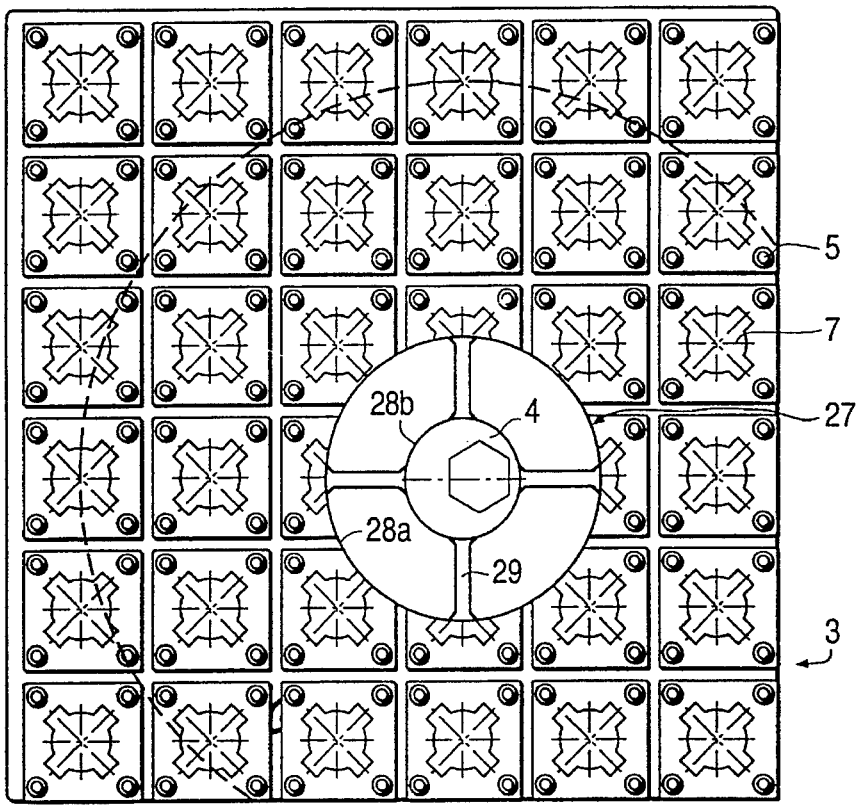
FIG. 15 is a top view of a bottom plate with a circular ring for receiving the loaded merchandise.
Figure 16:
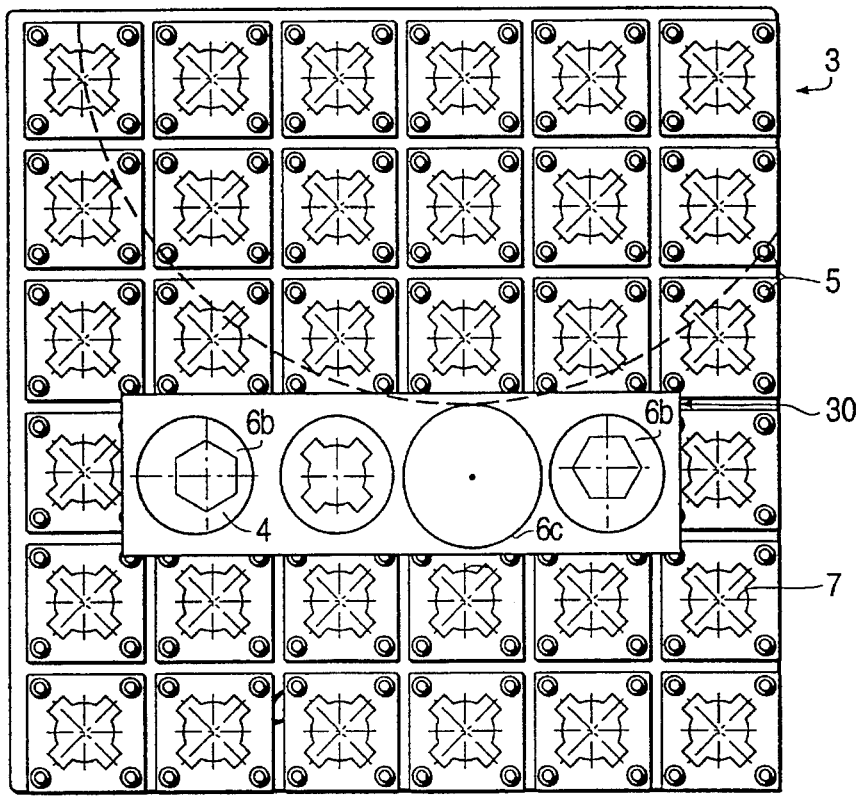
FIG. 16 is a top view of a bottom plate with fitted-on securing elements and cross-lining devices between the securing elements.

FIGS. 15 and 16 show complements for the fitting onto the securing stays 4. By means of the circular-ring-shaped body 27 (see FIG. 15), which is fitted onto an intermediate body 6*b* which, in turn, is connected with the bottom plate 3, an outlined machine part 5 is received by way of a central bore and is secured in the bottom plate plane. The circular-ring-shaped body 27 comprises two concentric circular rings 28*a* and 28 which are connected with one another by way of webs 29.

The bar-shaped cross-linking device 30 illustrated in FIG. 16 is fitted onto two securing stays 4 in order to reinforce them. The cross-linking device 30 is provided with four continuous bores situated in a row whose diameter corresponds to the outside diameter of a securing stay 4.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A device for variably securing loaded goods on the bottom surface of stiff containers, the bottom surface being provided with uniformly spaced receiving devices into which one securing stay respectively is removably inserted to stand on the bottom surface, wherein the securing stay comprises a first body securably joined with the bottom surface of at least one second body, and a pin plug-in connection that is eccentric with respect to at least one of the longitudinal axis of the first body and the second body, the pin plug-in connection connecting the first body with the second body.

2. A device according to claim 1, wherein the pin plug-in connection includes a frictional engagement.

3. A device according to claim 1, wherein the pin plug-in connection connecting the first body with the second body comprises a pin stub and a recess receiving the pin stub, the pin stub being connected with the first body, and the recess being provided into the second body, and the pin stub forming a fit with the recess.

4. A device according to claim 3, wherein the longitudinal axis of the pin stub and of the recess are offset by a distance parallel to the longitudinal axes of each of first and second bodies.

5. A device according to claim 4, wherein the pin stub is a regular prism, and the recess has a prismatic interior cross-section corresponding to the pin stub.

6. A device according to claim 5, wherein the second body is an expansion body that is an elastic bearing body which has a cone point and a base surface facing away from the cone point, the base surface including at least one of the recess and the pin stub.

7. A device according to claim 6, wherein the material of the elastic bearing body is an elastomer.

8. A device according to claim 3, wherein the second body is an expansion body that is a bearing body which has a central body bounded by two mutually parallel end faces on which at least one of the pin stub and the recess is molded.

9. A device according to claim 8, wherein the central body has a cylindrical shape.

10. A device according to claim 3, wherein the pin stub is a regular prism, and the recess has a prismatic interior cross-section corresponding to the pin stub.

11. A device according to 3, wherein the second body is an expansion body that is an elastic bearing body which has a cone point and a base surface facing away from the cone point, the base surface including at least one of the recess and the pin stub.

12. A device according to 3, wherein the second body is an expansion body that is an intermediate body which has a central body bounded by two mutually parallel end faces onto which central body the pin stub is provided on one of the end faces with the recess provided in the other end face.

13. A device according to claim 3, wherein the pin stub and the recess are offset with respect to the central body in opposite radial directions.

14. A device according to claim 3, wherein the first body is a bottom body that has a central body bounded by two mutually parallel end faces, and on one of the end faces a molded on base part which is inserted into the bottom surface, and, on the other of the end faces at least one of the pin stub and the recess being provided on the end face.

15. A device according to claim 7, wherein the second body is an expansion body that is an intermediate body which has a central body bounded by two mutually parallel end faces onto which central body the pin stub is provided on one of the end faces with the recess provided in the other end face.

16. A device according to claim 15, wherein the pin stub and the recess are offset with respect to the central body in opposite radial directions.

17. A device according to claim 16, wherein the first body is a bottom body that has a central body bounded by two mutually parallel end faces, and on one of the end faces a molded on base part which is removably inserted into the bottom surface, and, on the other of the end faces at least one of the pin stub and the recess being provided on the end face.

18. A device according to claim 15, wherein the central body has a cylindrical shape.

19. A device according to claim 1, wherein the material of the first and second bodies is a plastic material.

20. A device according to claim 1, wherein the first and second bodies rest flush against their adjoining end faces in a fitted-together condition.

21. A device according to claim 1, wherein the receiving devices are openings in the bottom surface, into which a base part is inserted which is provided onto the first body and releasably locked with the first surface by a rotating movement of the bottom body.

22. A device according to claim 21, wherein the openings are arranged on the bottom surface and are distributed in the manner of a chessboard.

23. A device according to claim 21, wherein the first body is securable against an unintentional rotating in the bottom surface by a snap mechanism.

24. A device according to claim 21, wherein the openings have slots which extend radially toward the outside and through which projections can be fitted which are molded to the base part and extend radially toward the outside, a gap formed between the projection and the first body corresponding to a bottom thickness in an edge area of the opening.

25. A device according to claim 24, wherein the openings have slots which are offset with respect to one another at a right angle on the circumference, and the base part has four projections which are arranged in a corresponding cross-shaped manner.

26. A device according to claim 1, wherein the bottom surface comprises a separate bottom plate connected with a container in a load-transferring manner.

27. A device according to claim 26, wherein the bottom plate comprises a plurality of rectangular partial plates.

28. A device according to claim 26, wherein the bottom plate has openings and underside facing away from the securing stay, the underside having at least one pair of molded-on noses which project toward the openings, one projection of the first body respectively being snapped into a gap formed between the pair of noses by rotation of the first body.

29. A device according to claim 28, wherein the openings are arranged on the bottom surface and are distributed in the manner of a chessboard.

30. An arrangement according to claim 1, wherein a top side of the bottom surface is subdivided into square individual areas by plug-in grooves extending in a grid.

31. A device according to claim 30, wherein one opening respectively is provided in the centers of the individual areas.

32. A device according to claim 30, wherein intersections of the plug-in grooves form receiving devices into which the first bodies are inserted.

33. A device according to claim 32, wherein the base part of the bottom body is inserted into the opening and into one of the intersections.

34. A device according to claim 30, further comprising partitions for subdividing the bottom surface, said partitions being inserted into the plug-in grooves.

35. A device according to claim 1, wherein the securing stay is an individual body which in one piece comprises the first body and the second body.

36. A device according to claim 1, further comprising cross-linking devices that connect the securing stays with one another, the cross-linking devices comprising several receiving points which are spaced from one another in the longitudinal direction of the cross-linking device, for connecting one securing stay 4 respectively with the cross-linking device, a distance between the receiving points corresponding to spacing of the receiving devices in the bottom surface.

37. A device according to claim 36, wherein the receiving points are formed by adjacent bores whose diameter is adapted to an outside diameter of the securing stay.

38. A device according to claim 36, wherein receiving points of adjacent recesses are formed for receiving the pin stubs of the pin plug-in connection.

39. A device according to claim 36, wherein the distance between the receiving points corresponds to at least one of horizontal and the diagonal spacing of the receiving devices in the bottom surface.

40. A device according to claim 1, further comprising at least one of a cylindrical and disk-shaped circular ring body that expands an outside diameter of the securing stay, an inside diameter of the circular-ring body corresponding to the outside diameter of the securing stay.

41. A device according to claim 40, wherein the circular-ring body comprises two concentric circular rings which are connected with one another by webs.

* * * * *